United States Patent [19]

Sano et al.

[11] 4,359,926

[45] Nov. 23, 1982

[54] WEAPON FIRING SYSTEM INCLUDING WEAPON INTERROGATION MEANS AND STRAY VOLTAGE TESTING MEANS

[75] Inventors: Frank M. Sano, Wayne; Edward J. Golden, Sussex; Robert A. Sliwa, Woodcliff Lake, all of N.J.

[73] Assignee: The Bendix Corporation, Teterboro, N.J.

[21] Appl. No.: 246,753

[22] Filed: Mar. 23, 1981

Related U.S. Application Data

[63] Continuation-in-part of Ser. No. 191,642, Sep. 26, 1980, Pat. No. 4,324,168.

[51] Int. Cl.[3] ..... F41F 3/04

[52] U.S. Cl. ..... 89/1.814; 102/215

[58] Field of Search ..... 89/1.814, 1.813, 1.5 E, 89/1.5 R; 102/215, 217

[56] References Cited

U.S. PATENT DOCUMENTS

| | | | |
|---|---|---|---|
| 3,499,363 | 3/1970 | Lauro | 89/1.814 X |
| 3,598,015 | 8/1971 | Delistovich et al. | 89/1.814 |
| 3,619,792 | 11/1971 | Capeci et al. | 89/1.814 X |
| 3,703,145 | 11/1972 | Burkhardt et al. | 89/1.814 X |
| 3,735,668 | 5/1973 | Langlois et al. | 89/1.814 |
| 3,748,955 | 7/1973 | Gatermann et al. | 89/1.814 |
| 4,103,585 | 8/1978 | Foley | 89/1.814 |

*Primary Examiner*—David H. Brown

*Attorney, Agent, or Firm*—Anthony F. Cuoco; Vett Parsigian

[57] ABSTRACT

A weapon firing system including weapon interrogation means is disclosed wherein a weapon control computer (8) provides a signal (at 27) for closing a normally open switch (16) and signals (at 29, 29A, 29B, 29N) for connecting one of a plurality of weapon select relays (18, 18A, 18B, 18N) to the switch. During weapon interrogation, a low level interrogation signal (from 20) is applied through the closed switch and the one relay to a weapon igniter (12, 12A, 12B, 12N) connected to a corresponding weapon (2, 2A, 2B, 2N) to interrogate the availability of the weapon for firing. The igniter provides an impedance indicative of said availability, which is sensed by a sensor (28) for providing a signal ($E_L$) which is applied to the computer for mission programming and display purposes. During weapon firing, a fire signal (from 32) is applied through the closed switch and one of the relays connected to the switch to fire the weapon connected to the relay in a firing sequence depending on the availability of the weapons. Prior to weapon interrogation, each weapon is tested via a stray voltage detector (32) to detect the presence of positive or negative voltage levels or pulses that may appear on an igniter and be indicative of an unsafe condition. The stray voltage detector is connected to the igniters which are sequentially powered, and provides an output ($E_S$) to the computer for alerting the operator of the potentially unsafe condition.

13 Claims, 2 Drawing Figures

WEAPON FIRING SYSTEM INCLUDING WEAPON INTERROGATION MEANS AND STRAY VOLTAGE TESTING MEANS

CROSS REFERENCE TO RELATED APPLICATIONS

This application is a continuation-in-part of commonly assigned copending U.S. Application Ser. No. 191,642, now U.S. Pat. No. 4,324,168, filed on Sept. 26, 1980, by Frank W. Sano, Robert A. Sliwa, and Edward J. Golden, inventors of the present invention.

BACKGROUND OF THE INVENTION

This invention relates to a system for electrically firing a plurality of weapons such as rockets carried by rocket launchers on a military helicopter or other military vehicle, and including interrogation means for determining the availability of rockets ready to be fired and means for determining stray voltages in excess of safe levels indicative of a potentially dangerous condition when system power is turned on.

Rocket firing systems of the type described include an electrically operable igniter associated with each rocket. The igniter is in the form of an electrical filament or resistance element which is heated by the passage of a firing current through the igniter. The heat is sufficient to fire means which ignites the propulsion charge of the rocket. The igniters are connected to a firing circuit which includes a firing lead connected to one side of the igniters with the other side thereof connected to ground. The firing lead of each rocket is connected by suitable circuitry to firing control means, whereby a firing signal is applied to each firing lead under the control of an operator.

It is advantageous to include interrogation means in the system for providing information relating to the availability of rockets ready to be fired, and to test the system prior to rocket loading and when the system is powered to detect the presence of stray voltages which can cause premature and/or unwanted firing of a rocket. The information obtained from the aforenoted interrogating and testing may be applied to a computer for programming and display purposes.

Prior art systems of the type described, such as particularly described in U.S. Pat. No. 4,103,585 issued to Nelson D. Foley on Aug. 1, 1978, and assigned to BEI Electronics, Inc., Little Rock, Arkansas, feature a plurality of rocket firing circuits connected to respective igniters of a plurality of rockets. A plurality of switching devices are connected to respective firing circuits and a plurality of signal circuits are connected between a signal source and respective switching devices. Each signal circuit includes indicating means for indicating the presence or absence of a signal current between a signal source and a corresponding igniter.

The invention described in the aforenoted copending U.S. Application Ser. No. 191,642 is an improvement over the prior art device in that it features a single signal circuit and a single indicating means to provide a more accurate, more reliable and more economical system. In combination with the above features, the present invention provides means for testing for stray voltages which may be indicative of a dangerous system condition.

SUMMARY OF THE INVENTION

This invention contemplates a weapon firing system including weapon interrogation means and stray voltage testing means, and utilizing common circuitry for the firing, interrogation and testing functions. A weapon control computer applies a signal for actuating one of a plurality of weapon select relays for connecting the relay arm to a normally open switch. The relay is latched in this state while the computer applies a signal for closing the switch, which applies a low level signal to an igniter connected to the relay arm to interrogate the weapon connected to the igniter. The igniter provides an impedance which is indicative of the availability of a weapon ready to be fired.

A sensor senses the impedance and applies a corresponding signal to the computer which stores the signal. The computer applies a signal for restoring the relay to its initial state and applies a signal for opening the switch. This sequence is repeated until each of the plurality of weapons is interrogated. The computer utilizes the stored signals to formulate a firing program sequence and to apply signals to a display device for displaying the results of the weapon interrogation.

The computer applies signals for closing the switch and for connecting the arm of one of the relays to the switch, whereby a firing signal is applied to a corresponding weapon igniter. The firing signal is of sufficient magnitude to fire the igniter and hence the weapon associated therewith in accordance with the programmed sequence.

Whenever the system is powered and prior to performing the aforenoted interrogation, a stray voltage detector detects any positive or negative voltage levels or pulses in excess of predetermined values that may appear on an igniter. The stray voltage detector applies an output to the computer which is indicative of whether a "safe" or "unsafe" condition exists on the igniter, and which output is displayed on the display device for alerting the operator of a potentially dangerous condition. The computer is effective for initiating the test of each igniter prior to its respective interrogation which is performed as aforenoted.

DETAILED DESCRIPTION OF THE INVENTION

Figure 1:
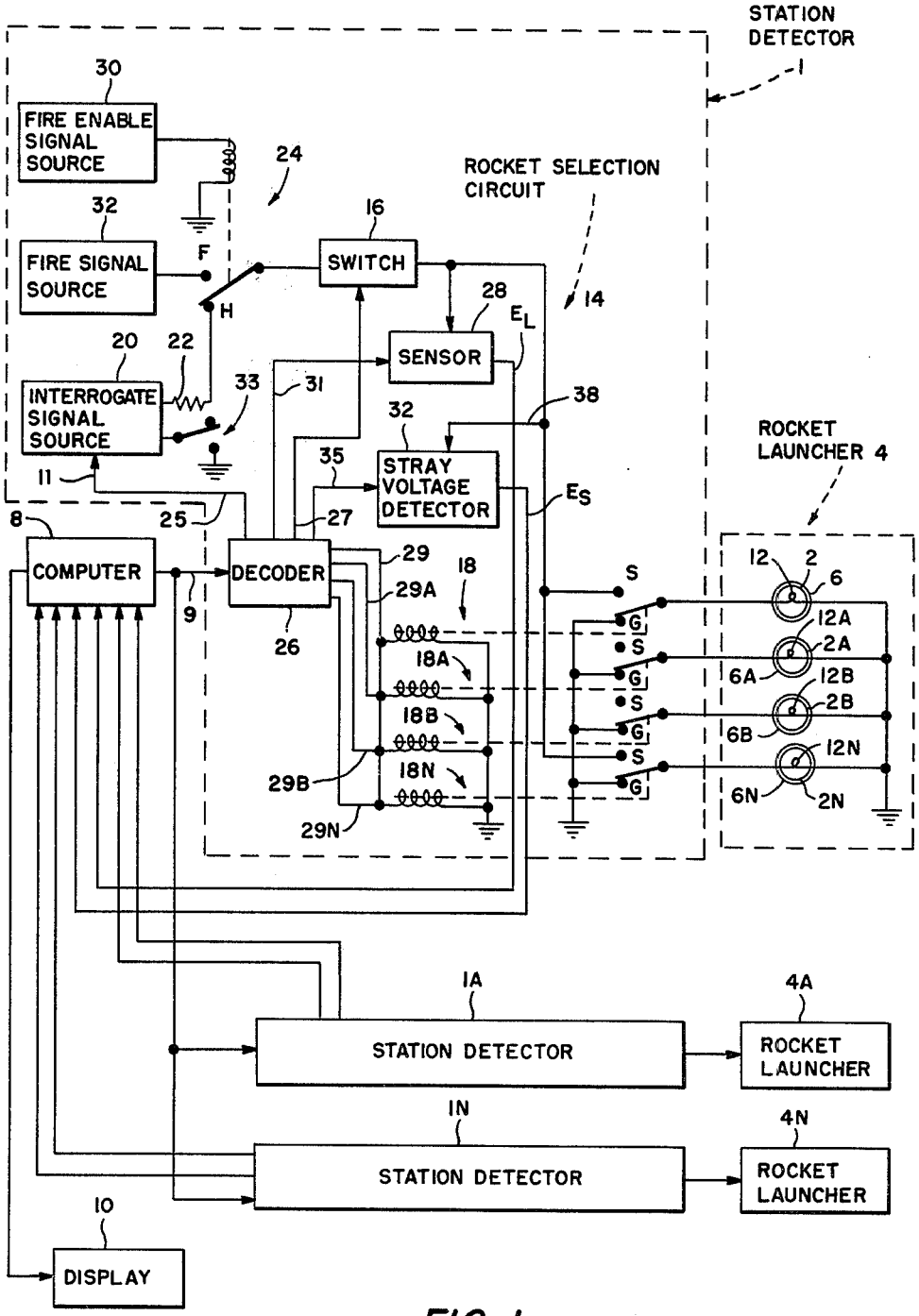
FIG. 1 is an electrical schematic-block diagram showing a system according to the invention.

The system illustrated in FIG. 1 is, by way of example, applied to firing a plurality of rockets designated as 2, 2A, 2B, and 2N adapted to be fired from a rocket launcher 4 such as carried by a helicopter or other military vehicle. Rocket launcher 4 has a corresponding plurality of rocket launching tubes designated as 6, 6A, 6B, and 6N.

While only four rockets and associated rocket launching tubes are shown for illustration purposes, rocket launcher 4 may carry more launching tubes which may, in turn, carry rockets of several different types. Further, groups of launching tubes may be disposed in different zones of rocket launcher 4 with rockets of various types carried in the different zones.

With the present invention, an inventory may be taken of rockets 2, 2A, 2B, and 2N on a current basis by a computer 8 having a display 10 associated therewith and indicating the number of rockets of each type which remain in rocket launcher 4 and are available for firing. An operator can read the display at any time to determine the number of rockets at his disposal. Computer 8 can also be arranged to provide a sequence for the firing of any desired number of rockets of each type. For these purposes, computer 8 may be, as a matter of illustration, a microprocessor of the type manufactured by the Intel Corporation and carrying their trade designation Model 8085.

Each rocket 2, 2A, 2B, and 2N has a corresponding igniter 12, 12A, 12B, and 12N, respectively, which may be in the form of a small electrical filament or resistance heating element which is heated by the passage of an electrical current therethrough. The heat generated by the igniter ignites a charge which, in turn, ignites the propulsion charge of the respective rocket 2, 2A, 2B, and 2N for firing the rocket.

Each igniter 12, 12A, 12B, and 12N is connected to a common rocket selection circuit designated by the numeral 14 and including a normally open electronic switch 16, which may be a conventional type field effect transistor, and further including relays 18, 18A, 18B, and 18N. One leg (the firing leg) of each of the igniters 12, 12A, 12B, and 12N is connected to the arm of a corresponding relay 18, 18A, 18B, and 18N, while the other leg of each of the igniters is connected to a common ground.

Rocket interrogation is accomplished when a signal from an interrogate signal source 20 is applied through a resistor 22 and a relay 24 having its arm in a position H so as to connect the interrogate signal source to switch 16.

Upon operator initiation of the interrogation sequence via computer 8, the computer provides a coded rocket selection signal at an output conductor 9, which is applied to a decoder 26. Decoder 26, which may be a series of conventional logic gates, decodes the coded signal and provides output signals at output conductors 25 and 27, and, for example, at an output conductor 29. The signal at conductor 25 triggers signal source 20 to provide the aforenoted interrogate signal; the signal at conductor 27 is effective for closing switch 16; and the signal at conductor 29 is effective for energizing relay 18 to displace the relay arm from a safe power ground position G to a position S connecting the relay arm to now closed switch 16.

Switch 16 passes the interrogate signal, applied through resistor 22 as aforenoted, to activate igniter 12 of rocket 2. The value of resistor 22 is such that the igniter activating signal is much below the magnitude/-time specified for "safety" or "non-firing" of the rocket.

Upon receipt of the interrogation signal, igniter 12 presents an impedance to switch 16. An impedance of infinity indicates that rocket igniter 12 is open or that a rocket is not available in launching tube 6 of weapon launcher 4. An impedance in the magnitude of 10 ohms or less, for example, indicates that a valid rocket igniter is present and a rocket is available in the designated launching tube. Hence, a voltage/current relationship is established by the igniter, with its magnitude being dependent upon the impedance value of the igniter.

A sensor circuit 28, which may be a conventional type transistor circuit, is connected across the output of switch 16 and senses the aforenoted impedance to apply a logic output response signal $E_L$ to computer 8 indicating the availability status of rocket 2 for the particular interrogation interval. Computer 8 stores the information in memory and transmits a coded signal over output conductor 9 to decoder 26 which provides signals at output conductors 27 and 29, which are effective for opening switch 16 and for restoring relay 18 to its initial state, i.e., the relay arm in position G, respectively. Decoder 26 provides a signal at an output conductor 31 for resetting sensor 28.

Computer 8 applies coded signals over output conductor 9 to decoder 26, which provides signals at output conductor 27 and at output conductors 29A, 29B, and 29N for sequentially interrogating rockets 2A, 2B, and 2N as heretofore explained until each rocket has been so interrogated. The computer uses the stored information resulting from the interrogation to formulate a firing order program and to display the correct quantity of rockets available for firing on display device 10.

With rockets 2, 2A, 2B, and 2N interrogated as described, the rockets available for firing may be fired in a predetermined firing sequence as determined by computer 8.

Upon operator initiation of the firing sequence via computer 8, the computer provides a signal which is applied over output conductor 9 to decoder 26. Decoder 26 decodes the signal and provides a signal at output conductor 27 for closing open switch 16 and provides, for example, a signal at output conductor 29 which actuates relay 18 for displacing the relay arm from position G to position S, whereby rocket igniter 12 is connected to switch 16, as is the case during rocket interrogation.

A fire enable signal source 30 is operator-operated for actuating relay 24 whereupon the relay arm is displaced from position H to position F to apply a fire signal from a fire signal source 32 through closed switch 16 and the relay arm of relay 18 to igniter 12 to ignite the igniter and fire rocket 2.

Upon firing of rocket 2, decoder 26 is responsive to a signal from computer 8 applied over output conductor 9 for providing a signal at output conductor 27 to open switch 16; and for providing a signal at output conductor 29 to actuate relay 18 to return the relay arm to its initial ground position. The decoder provides a signal at output conductor 27 for closing the switch and provides signals at output conductors 29A, 29B, and 29N, as the case may be, for sequentially firing previously interrogated and available rockets 2A, 2B, and 2N, as the case may be, as heretofore described. During the firing sequence, sensor 28 is ineffective and any signal $E_L$ provided thereby is ignored by computer 8.

With continued reference to FIG. 1, prior to performing the interrogation test as aforenoted, a stray voltage test is performed to detect any positive or negative voltage levels in excess of predetermined safe values that may appear on rocket igniters 12, 12A, 12B, or 12N.

The stray voltage test is accomplished by connecting a stray voltage detector 32 to the respective arms of relays 18, 18A, 18B, and 18N, between switch 16 and the relay arms via a conductor 38. Upon initiation of the stray voltage test via computer 8, an output signal is applied over output conductor 9 to decoder 26. Decoder 26 applies a signal over output conductor 25, which activates interrogate signal source 20. The interrogate signal source is manually set via switch 33, whereby the switch arm is connected to ground so that the output signal from interrogate signal source 20 is at substantially ground level.

Decoder 26 provides an output signal over output conductor 27, which closes switch 16, and provides an output signal over output conductor 29, for example, which is effective for energizing relay 18 to displace the relay arm from safe power ground position G to position S connecting the relay arm to now closed switch 16 so that the system is in a "powered" condition. Since the signal passing from signal source 20 through closed switch 16 to igniter 12 is at ground level, the igniter is electrically isolated. Any stray signal or pulse on igniter 12 which may create an unsafe condition is sensed by stray voltage detector 32. The stray voltage detector provides a signal $E_S$ which is applied to computer 8, and which signal is at logic levels indicating that either "safe" or "unsafe" conditions exist on igniter 12.

The computer stores the information thus provided and then proceeds to perform the interrogation of igniter 12, as heretofore described. Computer 8 thereupon provides a signal over output conductor 9 to decoder 26, which applies a reset signal over output conductor 31 to reset sensor 28 and applies a reset signal over an output conductor 35 to reset stray voltage detector 32. Computer 9, in the same manner, proceeds to test and interrogate rockets 12A, 12B, and 12N, as the case may be.

Figure 2:
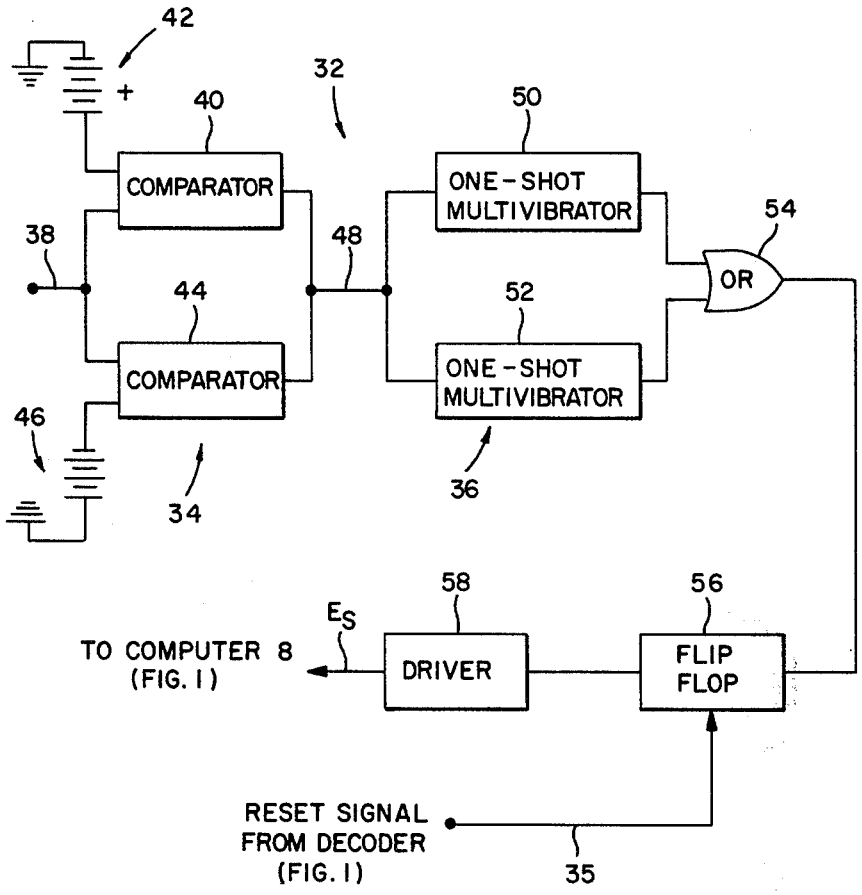
FIG. 2 is an electrical schematic-block diagram showing in detail a stray voltage detector which is generally shown in FIG. 1.

With particular reference to FIG. 2, stray voltage detector 32 is shown in detail. The stray voltage detector detects any positive or negative voltages or pulses in excess of predetermined safe levels. The positive and negative voltage levels are detected by an arrangement of voltage comparators designated generally by the numeral 34, and the positive and negative pulses are detected by an arrangement of one-shot multivibrators designated generally by the numeral 36.

Thus, any stray voltage sensed by stray voltage detector 32 as may appear on igniters 12, 12A, 12B, or 12N is applied at conductor 38 and therefrom to comparator arrangement 34. Comparator arrangement 34 includes a comparator 40 referenced to a positive source of DC voltage shown as a battery 42 and a comparator 44 referenced to a negative source of DC voltage shown as a battery 46. The output of comparator arrangement 34 is applied over an output conductor 48 to pulse width detector 36, which includes a conventional one-shot multivibrator 50 and another like one-shot multivibrator 52.

The outputs of multivibrators 50 and 52 are applied to a conventional logic OR gate 54, which applies an output to a conventional flip-flop circuit 56. Flip-flop 56 drives a transistor driver which provides an output over conductor $E_S$ to computer 8 that is indicative of a positive or negative "safe" or "unsafe" stray voltage or pulse level, as the case may be. The reset signal is applied over conductor 35 to flip-flop 56, which resets stray voltage detector 32 in readiness for testing another igniter until all such igniters have been tested.

For purposes of illustration, the aforenoted rocket testing, interrogation and firing has been described with reference to a single rocket station detector, associated with a single rocket launcher 4. It is to be understood, however, that a number of rocket launchers 4A–4N can be tested and interrogated simultaneously through other associated station detectors 1A–1N as shown in FIG. 1, each of which receives inputs from computer 8 and provides outputs which are fed back to computer 8, as heretofore described. In this event, each station detector would include its own decoder 8, rocket selection circuit 4 including switch 16, sensor 28 and detector 32; interrogate signal source 20; fire enable source 30; and fire signal source 32.

We claim:

1. A weapon firing system and stray signal testing means, the combination comprising:

a plurality of weapon select means, each of which is connected to a firing means associated with a weapon in a corresponding plurality of weapons;

a signal source for providing a signal at substantially ground level;

normally open switching means;

means operable for connecting the normally open switching means to the signal source;

control means connected to the normally open switching means and to the plurality of weapon select means for independently connecting each of the weapon select means to the normally open switching means, and for closing said switching means to pass the substantially ground level signal therethrough which electrically isolates a corresponding weapon firing means; and a stray signal detector connected between the closed switching means and the independently connected weapon select means for detecting stray signals on the corresponding associated weapon firing means.

2. The combination as described by claim 1, including:

means for providing a fire signal;

the means operable for connecting the normally open switching means to the signal source being operable for disconnecting the normally open switching means from the signal source and for connecting the normally open switching means to the fire signal means;

the control means connected to the normally open switching means and to the plurality of weapon select means for independently connecting each of the weapon select means to the normally open switching means, and for closing said switching means to pass the fire signal therethrough; and the fire signal being applied to an independently connected weapon select means and therefrom to a corresponding associated weapon firing means for firing the weapon.

3. The combination as described by claim 1, wherein:

the stray signal detector detects stray positive and negative voltage levels, and stray positive and negative pulses.

4. The combination as described by claim 1, including:

a signal source for providing an interrogation signal at a predetermined level;

the control means connected to the normally open switching means and to the plurality of weapon select means for independently connecting each of the weapon select means to the normally open switching means, and for closing said switching means to pass the interrogate signal therethrough; and a sensor connected between the closed switching means and the independently connected weapon select means for sensing the impedance provided by a corresponding associated weapon firing means in response to the interrogation signal, and which impedance is indicative of the availability of a weapon to be fired.

5. The combination as described by claim 4, wherein the signal source for providing a signal at substantially ground level and the signal source for providing an interrogation signal at a predetermined level include:

means for providing a signal;

a resistor connected to the signal providing means; and a switch connected to the signal providing means and operable to a first open position whereby the signal from said signal providing means is applied through the resistor to provide the interrogation signal at the predetermined level, and operable to a second closed to ground position whereby the signal providing means provides the substantially ground level signal.

6. A weapon firing system including stray voltage testing means and weapon interrogation means, comprising:

a plurality of weapon select means, each of which is connected to a corresponding firing means associated with a weapon in a corresponding plurality of weapons;

a first signal source;

means associated with the first signal source and operable therewith so that the first signal source provides a first signal at a first predetermined level and a second signal at a second predetermined level;

a second signal source for providing a third signal;

normally open switching means;

means operable for independently connecting the normally open switching means to the first and second signal sources;

control means connected to the plurality of weapon select means for independently connecting each of the weapon select means to the normally open switching means, and connected to the normally open switching means for closing said means, with the first and second signals from the first signal source and the third signal from the second signal source being independently applied through the plurality of weapon select means and therefrom to the corresponding weapon firing means;

the first signal from the first signal source being effective for electrically isolating the weapon firing means so that the presence of stray signals on said firing means can be detected;

means connected between the weapon select means and the closed switching means for detecting said stray signals;

the weapon firing means being responsive to the second signal from the second signal source for interrogating a weapon firing means to provide an impedance indicative of a weapon available for firing;

means connected between the weapon select means and the closed switching means for detecting said impedance; and the weapon firing means being responsive to the third signal for firing the corresponding weapon upon said weapon being available for firing.

7. A weapon firing system as described by claim 6, wherein:

the control means is connected to the stray signal detecting means for resetting said means after the weapon firing means has been tested for the presence of stray signals.

8. A weapon firing system as described in claim 6, wherein:

the control means is connected to the impedance detecting means for resetting said means after the weapon firing means has been interrogated.

9. A weapon firing system as described by claim 6, wherein:

the stray signal detecting means provides a logic output indicative of the presence of stray signals on the weapon firing means; and said logic output is applied to the control means for controlling said means.

10. A weapon firing system as described by claim 6, wherein:

the impedance detecting means provides a logic output indicative of the impedance on the weapon firing means; and said logic output is applied to the control means for controlling said means.

11. A weapon firing system as described by claim 6, wherein:

the means associated with the first signal source and operable therewith so that the first signal source provides a first signal at a final predetermined level and a second signal at a second predetermined level includes;

a resistor connected to the output of the first signal source;

a switch connected to the output of the first signal source and operable to a closed position so that the output from the signal source bypasses the resistor to provide the first signal;

and the switch operable to an open position whereby the output from the signal source passes through the resistor to provide the second signal.

12. A weapon firing system as described by claim 11, wherein:

the resistor scales the output from the signal source to provide the first signal at a level which affects the weapon firing means so that said means provides the impedance indicative of a weapon available for firing.

13. A weapon firing system as described by claim 11, wherein:

the switch operable to a closed position is operable to ground so that the first signal is at substantially ground level for electrically isolating the weapon firing means.

* * * * *